US009296097B2

(12) United States Patent
Osborn

(10) Patent No.: US 9,296,097 B2
(45) Date of Patent: Mar. 29, 2016

(54) TOOL AND METHOD FOR SETTING T AND G FLOORING FASTENERS

(71) Applicant: Michael Burton Osborn, Edmonds, WA (US)

(72) Inventor: Michael Burton Osborn, Edmonds, WA (US)

( * ) Notice: Subject to any disclaimer, the term of this patent is extended or adjusted under 35 U.S.C. 154(b) by 262 days.

(21) Appl. No.: 14/180,195

(22) Filed: Feb. 13, 2014

(65) Prior Publication Data

US 2014/0224072 A1 Aug. 14, 2014

Related U.S. Application Data

(60) Provisional application No. 61/850,409, filed on Feb. 13, 2013.

(51) Int. Cl.
*B25C 3/00* (2006.01)

(52) U.S. Cl.
CPC ..... *B25C 3/006* (2013.01); *Y10T 29/49947* (2015.01)

(58) Field of Classification Search
CPC ..... B25C 3/006; B25C 3/00
USPC ..... 81/44; 29/525.01
See application file for complete search history.

(56) References Cited

U.S. PATENT DOCUMENTS

| | | | | |
|---|---|---|---|---|
| 788,564 | A * | 5/1905 | Thompson | B25C 3/008 81/44 |
| 1,002,102 | A * | 8/1911 | Weedon | B25C 3/008 81/44 |
| 1,016,383 | A | 2/1912 | Wellman | |
| 1,213,334 | A | 1/1917 | Chapman | |
| 3,010,496 | A * | 11/1961 | Bruce | B25C 3/006 81/44 |
| 3,166,757 | A * | 1/1965 | Downs, Jr. | B25C 7/00 227/147 |
| 6,520,050 | B1 * | 2/2003 | Gildroy | B25C 3/008 81/44 |
| 7,837,078 | B2 | 11/2010 | Clark | |
| 7,878,383 | B2 | 2/2011 | Marschel | |

* cited by examiner

*Primary Examiner* — David B Thomas
(74) *Attorney, Agent, or Firm* — Christensen O'Connor Johnson Kindness PLLC

(57) ABSTRACT

A rectangular one-piece unitary block of hard durable material has a central slot opening through one side and the bottom. The depth of the slot measured from the bottom of the block to the slot base in the interior is greater toward such one side. The slot becomes progressively more shallow in a direction toward the opposite side of the block to a location where the slot feathers into the bottom. The head of a high fastener projecting from an exposed edge of a T & G plank can be captured in the deeper portion of the slot, followed by shifting the block with its bottom engaged against the plank and the fastener head engaged by the base of the slot while rapping the top of the block with a hammer. The high fastener is thereby progressively driven to a set position.

2 Claims, 3 Drawing Sheets

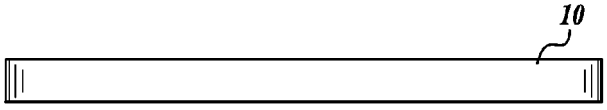
Fig. 2.
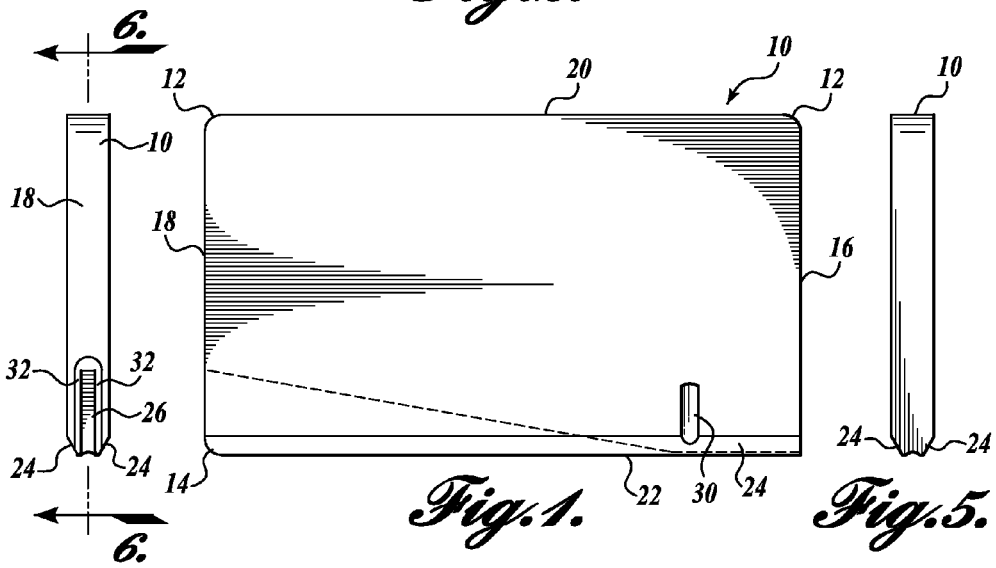
Fig. 1.
Fig. 5.
Fig. 4.
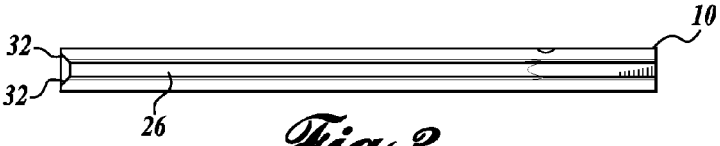
Fig. 3.
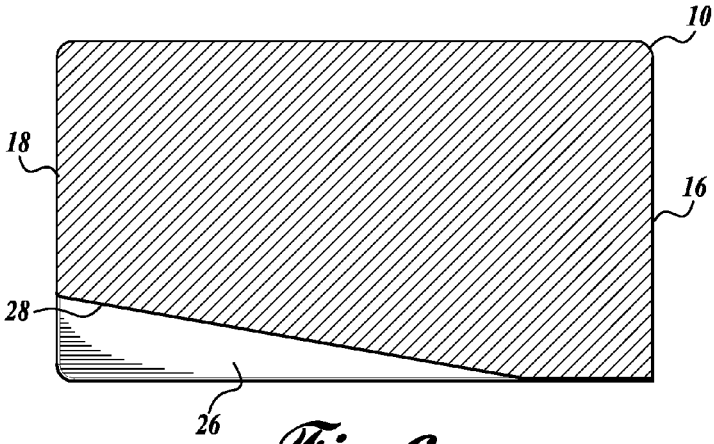
Fig. 6.

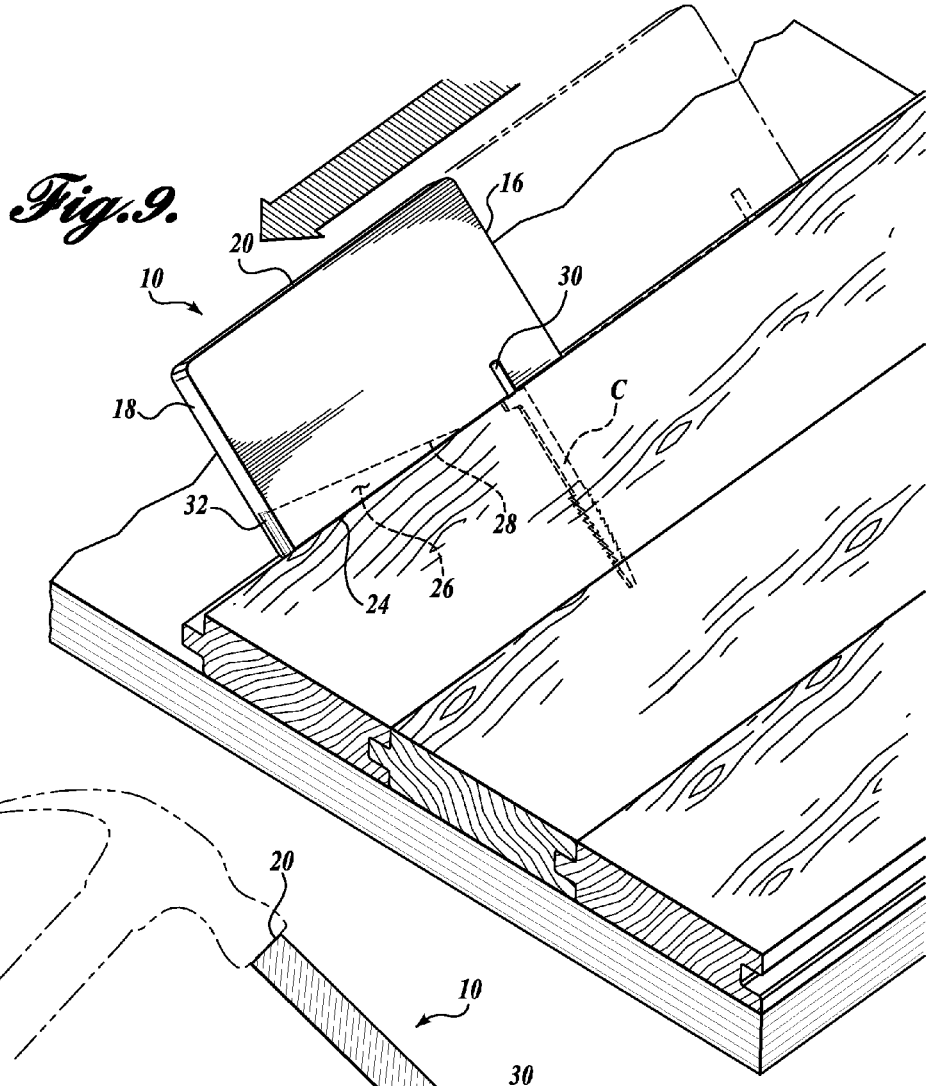
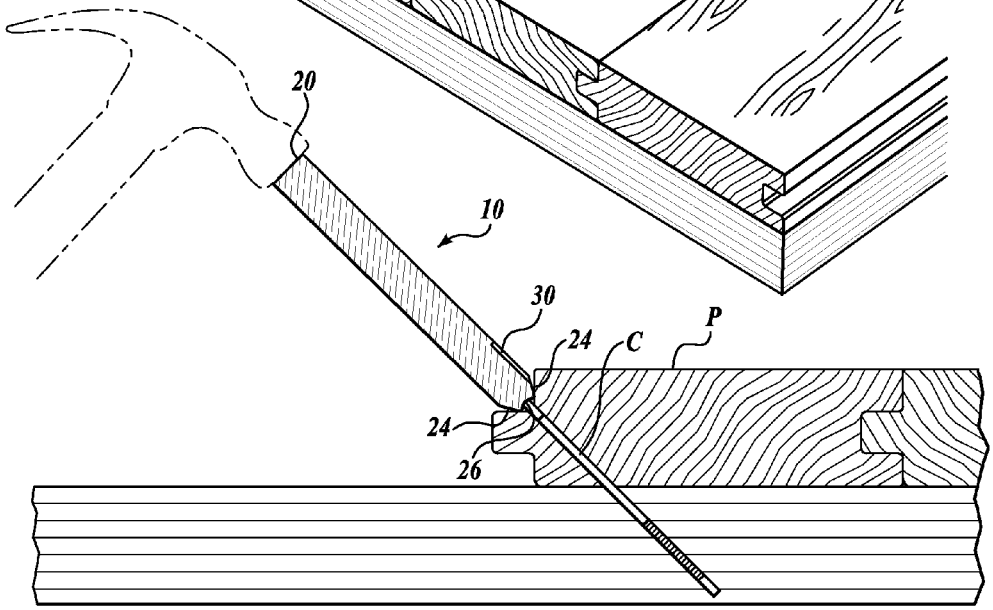
Fig.10.

TOOL AND METHOD FOR SETTING T AND G FLOORING FASTENERS

CROSS-REFERENCE TO RELATED APPLICATION

This application claims the benefit of Provisional Application No. 61/850409, filed on Feb. 13, 2013.

BACKGROUND

Conventional hardwood flooring uses tongue and groove planks During installation on a backing or subfloor, the groove edge of one plank is fitted against the tongue edge of a previously installed plank. Typically a pneumatic nail gun (a "flooring nailer") is used to drive a shanked fastener from a strip or magazine at an angle of 45 degrees down and toward the previously installed plank at the location where the plank tongue projects from the exposed plank edge. Preferably, the fastener is driven flush with the tongue edge of the plank, but occasionally a fastener will be left "high." For example, a high fastener may result from low air pressure to the nailer and/or a hard spot in the flooring plank or subfloor. Depending on the skill and inclination of the installer, a high fastener may be driven flush with nothing more than a hammer, or a punch-type carpenter's nail set can be used, or a flat screwdriver or chisel, any of which may damage the tongue or mar the face of the flooring plank and/or bend or distort the fastener without adequately setting it. These problems can interfere with proper fit of a subsequent plank in addition to being irritating and time consuming.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present invention provides a tool in the form of a one-piece unitary block of hard durable material such as tool steel. The block can be rectangular, having top, bottom and opposite side edges, approximately the size of a standard credit card but thicker. A central slot opens through the bottom and one side edge. The slot has a base at the interior of the block, inclined from the bottom edge near one side edge toward the opposite side edge through which the deepest part of the slot opens. The width of the slot is selected for capturing the projecting head portion of high fastener that projects from an exposed edge of a T & G plank. The high fastener can be progressively driven to a set position by receiving the projecting head in a deeper part of the slot and shifting the block for engaging the head in increasingly shallower parts of the slot while rapping the top of the block with a hammer.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 1 is a front elevation of a tool for setting tongue and groove (T & G) flooring cleats in accordance with the present invention;

FIG. 2 is a top plan thereof;

FIG. 3 is a bottom plan thereof;

FIG. 4 is a left side elevation thereof;

FIG. 5 is a right side elevation thereof; and

FIG. 6 is a longitudinal section thereof taken along line 6-6 of FIG. 4;

FIG. 9 is a top perspective corresponding to FIG. 7 but with parts in different positions; and FIG. 10 is a side elevation thereof with parts shown in section.

DETAILED DESCRIPTION

Figure 7:
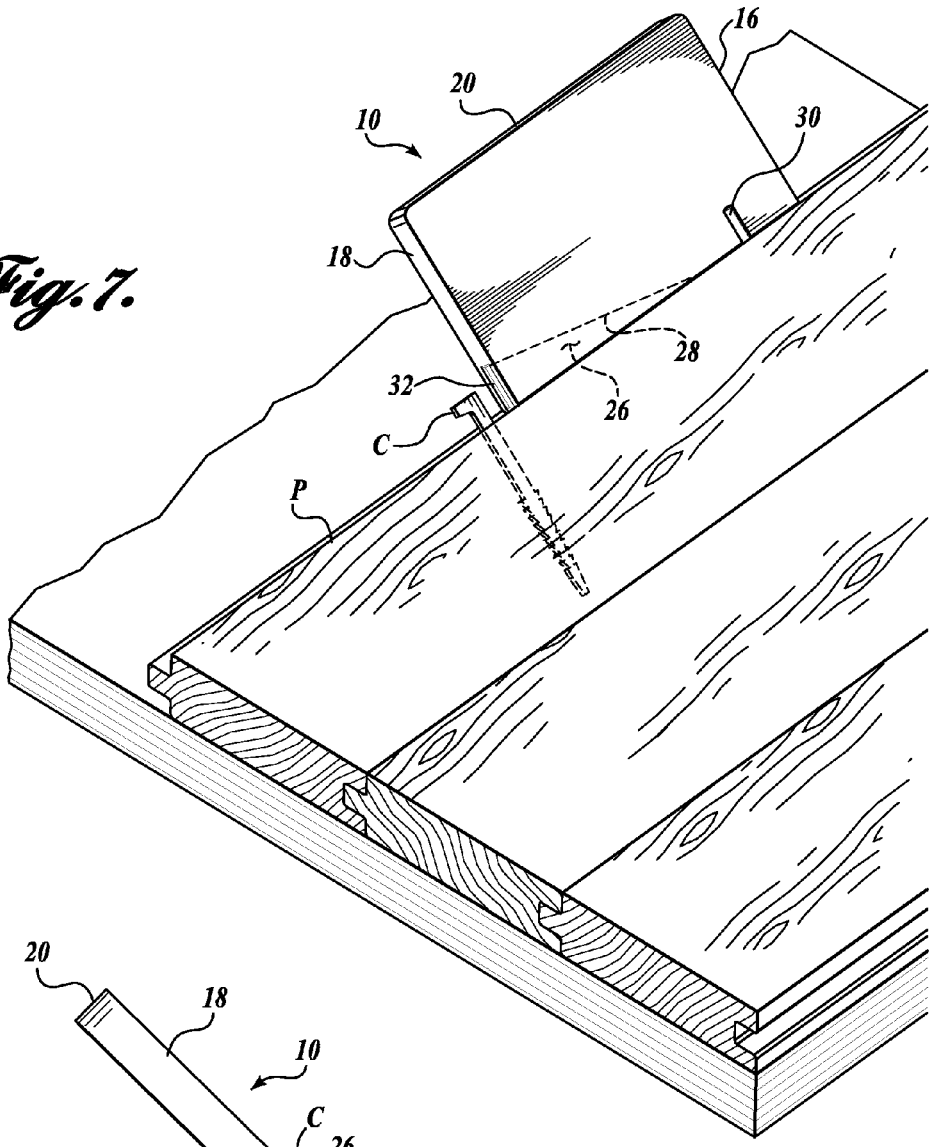
FIG. 7 is a somewhat diagrammatic top perspective illustrating a tool in accordance with FIGS. 1-6 positioned for use in setting a high flooring cleat.

The present invention provides an improved tool and method for quickly and effectively setting a high flooring fastener that has been incompletely driven during installation of a T & G flooring plank. The preferred embodiment is adapted for setting cleat fasteners of the type shown in the drawings and described herein.

In the embodiment shown in FIGS. 1-6, the tool is a unitary rectangular block 10 of rigid durable material such as hardened tool steel. In the orientation shown, the tool 10 is longer than it is wide, as seen in FIG. 1, and mostly of uniform thickness as seen in FIGS. 2-5. Both top corners 12 and the bottom left corner 14 can be rounded. The left and right side edges 16 and 18 are parallel, as are the top and bottom edges 20 and 22. The marginal portions of the front and rear faces of the tool have short bevels 24 adjacent to the bottom edge 22, as best seen in FIGS. 4 and 5. A cleat-receiving central slot 26 opens through the left edge 18 and the majority of the bottom edge 22. The deepest part of the slot is at the opening through the left edge 18. The slot becomes progressively shallower toward the opposite edge 16. In the preferred embodiment the base 18 of the slot extends linearly and obliquely from the left edge to approximately the location of a stamped index marking 30 (FIG. 1) where the base of the slot feathers out to the bottom edge 22. From such marking to the junction with the right edge 16, the bottom edge 22 can be solid and flat, but in the preferred embodiment is slightly concave. At the opposite, deeper end of the slot, the slot opening has chamfers 32 (best seen in FIG. 3) which can assist in positioning the tool during use as described in more detail below.

Figure 8:
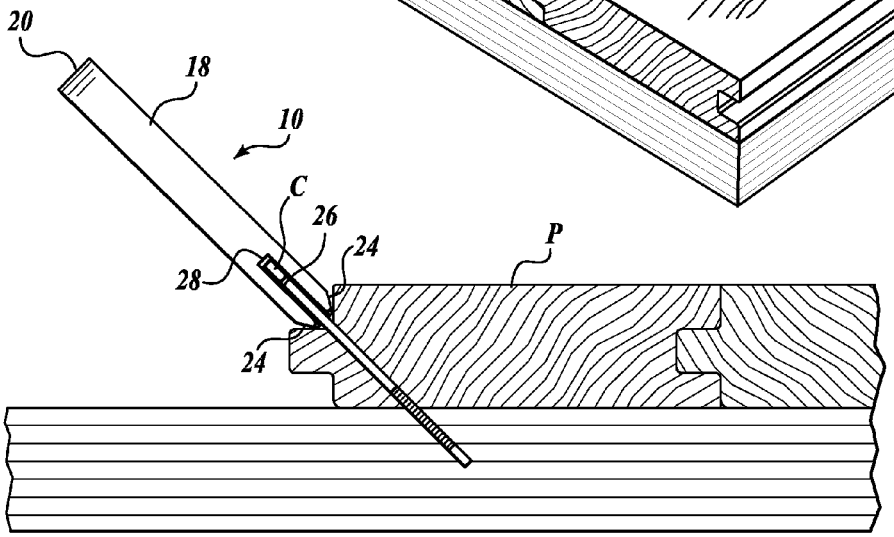
FIG. 8 is a somewhat diagrammatic side elevation thereof.

FIGS. 7-10 illustrate use of the tool of FIGS. 1-6 for setting a high flooring fastener. The cleat C shown in FIG. 7, for example, is typical and includes a long shank portion and a somewhat wider head portion. The cleat illustrated is high in that it has not been driven sufficiently that the head is flush with the tongue edge of the corresponding flooring plank P. In accordance with the present invention, the tool block 10 is first placed adjacent to the high cleat C, with the bottom edge bevels in the notch formed between the top of the exposed plank tongue and the upright edge of the plank. To set the high cleat, the block 10 is positioned with the slot 26 aligned with the projecting head end portion of the cleat. In this regard, the bottom bevels 24 engage against the exposed tongue and edge of the plank as best seen in FIG. 8. In most cases, the high end of the cleat will be at an angle of 45 degrees, but sometimes the angle is slightly more or less than 45 degrees. Consequently, it is preferred that the bevels 32 are more acute than 45 degrees, such as at least about 50 degrees at each side, to allow for convenient adjustment of the angle of the slot 26 to match the cleat, by manual tilting of the tool block.

Next, the block 10 is slid to capture the head of the cleat C in the slot 26 until the head of the cleat is engaged against the base of the slot with opposite sides of the cleat being held between opposite sides of the slot. The top side of the tool block is rapped with a hammer or mallet as the block is moved more to the left, as diagrammatically indicated in FIGS. 9 and 10, progressively sinking the cleat in the backing or subfloor. As the base of the shallowest part of the slot is reached, the head of the cleat is cupped in the concave bottom edge of the block. The result is a quick, easy, and reliable setting of the cleat to the preferred position with its head flush or nearly flush with the exposed edge of the plank P. The worker can gauge when this has been achieved by the position of the index marking 30. When the marking is aligned with the cleat location and the beveled bottom end of the block is tight in the notch, the cleat is sufficiently set.

Dimensions of the block 10 are selected based on ease of use and the particular application. In a representative embodiment, the block 10 can be approximately 2 inches high by 3.5 inches long and about 0.25 inch thick. The cleat slot or channel can be 0.08 inch wide which provides reasonable clearance for conventional 16 gauge cleats (a wider or narrower channel may be used for other fasteners; for example best results may be obtained with a narrower channel for cleats thinner than 18 gauge). The maximum depth of the slot (at the left edge) can be 0.5 inch, and the slot can feather into the bottom edge of the block at about 0.625 inch from the right side, adjacent to the location of the index marking 30. As noted above, the upright slot edge preferably is chamfered for ease in guiding a high cleat head into the slot.

Overall, the block is not much larger than a standard credit card, though substantially thicker and, of course, heavier, but still can be conveniently kept in a pocket.

Orientation can be felt easily due to the three rounded corners and one sharp corner. With experience an installer can easily fetch and orient the block and slide or draw it over a high cleat in a continuous motion while rapping the block a few times to set the cleat.

While illustrative embodiments have been illustrated and described, it will be appreciated that various changes can be made therein without departing from the spirit and scope of the invention.

The embodiments of the invention in which an exclusive property or privilege is claimed are defined as follows:

1. A tool for setting a high fastener having a shank driven into a T & G plank and a head portion projecting from an exposed edge of the plank, said tool comprising a one-piece unitary block of durable hard material having:

opposite top and bottom edges, and opposite side edges extending between the opposite top and bottom edges; and a head-receiving central slot opening through one of the side edges and through the bottom edge, the slot having a base in the interior of the block, the depth of the slot measured from the bottom edge to the base being greatest toward said one side edge and being progressively more shallow in a direction toward the opposite side edge to a location where the slot feathers into the bottom edge of the block, the slot having a transverse width sized to receive a projecting head portion of a high fastener with opposite sides of the high fastener head portion held between opposite sides of the slot with the bottom edge of the block in engagement with a plank from which the high fastener projects, the slot being constructed and arranged for engagement of the high fastener head portion against the base by shifting the block over the high fastener with the bottom edge in engagement with the plank for progressive driving of the fastener to a set position by rapping the top edge of the block in successive shifted positions.

2. The method of setting a high fastener having a shank driven into a T & G plank and a head portion projecting from an exposed edge of the plank, which method comprises:

receiving the projecting head portion in a central slot of a one-piece unitary block of hard durable material which block has opposite top and bottom edges and opposite side edges extending between the opposite top and bottom edges, the slot opening through one of the side edges and through the bottom edge and having a base in the interior of the block, the depth of the slot measured from the bottom edge to the base being greatest toward said one side edge and being progressively more shallow in a direction toward the opposite side edge to a location where the slot feathers into the bottom edge of the block, the slot having a transverse width sized to receive the projecting head portion of the high fastener with opposite sides of the head portion held between opposite sides of the slot; and shifting the block with its bottom edge in engagement with the exposed plank edge to a position where the base of the slot engages against the head of the fastener, followed by shifting the block farther in a direction of increasingly shallow depth of the slot while rapping the top edge of the block to progressively drive the fastener to a set position.

* * * * *